US007608090B2

(12) United States Patent
Matsui

(10) Patent No.: US 7,608,090 B2
(45) Date of Patent: Oct. 27, 2009

(54) METHOD OF BEAUTIFICATION AND FACELIFTING USING A STRETCH TAPE

(75) Inventor: Hideki Matsui, Osaka (JP)

(73) Assignee: Kazu Investment Co., Ltd., Izumisano-shi (JP)

( * ) Notice: Subject to any disclaimer, the term of this patent is extended or adjusted under 35 U.S.C. 154(b) by 0 days.

(21) Appl. No.: 10/541,939

(22) PCT Filed: Jan. 14, 2004

(86) PCT No.: PCT/JP2004/000196

§ 371 (c)(1),
(2), (4) Date: Jul. 12, 2005

(87) PCT Pub. No.: WO2004/062427

PCT Pub. Date: Jul. 29, 2004

(65) Prior Publication Data

US 2006/0115519 A1 Jun. 1, 2006

(30) Foreign Application Priority Data

Jan. 14, 2003 (JP) ..... 2003-006455
Apr. 11, 2003 (JP) ..... 2003-108488

(51) Int. Cl.
*A45D 44/22* (2006.01)
*A61F 5/37* (2006.01)
*A61F 13/02* (2006.01)

(52) U.S. Cl. ..... 606/204.35; 602/1

(58) Field of Classification Search ..... 424/443, 424/401–402; 602/1, 74–77; 606/204.35, 606/204.45, 204.15, 204.25; 482/11; 128/898
See application file for complete search history.

(56) References Cited

U.S. PATENT DOCUMENTS 1,215,117 A * 2/1917 Cornish ..... 606/204.35

(Continued)

FOREIGN PATENT DOCUMENTS

FR 2512651 A * 3/1983

(Continued)

OTHER PUBLICATIONS

Wrinkies & Frownies, webpage at http://web.archive.org/web/20001004172509/www.frownies.com/product.html, archived webpages dated Oct. 4, 2000.*

*Primary Examiner*—Loan H Thanh
*Assistant Examiner*—Victor K Hwang
(74) *Attorney, Agent, or Firm*—Westerman, Hattori, Daniels & Adrian, LLP

(57) ABSTRACT

The stretch tape of the present invention for eyelid facelifting is stuck between eyes and near inner corners of eyes, or near the outer corner of each eye, enabling facelifting which makes the eyes look slitter and brighter by stretching the skins of eyelids by the stretch tape. The stretch tape is tapered so that the stretch tape points the inner edge or the outer edge of the eye. The stretch tape of the present invention for nose facelifting has a shape of an inverted character U or an inverted character V, the top portion of the inverted U or V shape is stuck to an upper portion of the nose in between eyes, and both foot portions of the inverted U or the V shape are stuck at both sides of the hillside portion of the nose, so that the stretch tape stretches the hillside portion of the nose toward a head.

2 Claims, 10 Drawing Sheets

U.S. PATENT DOCUMENTS

| | | | | | |
|---|---|---|---|---|---|
| 2,001,862 | A | * | 5/1935 | Battey | 606/204.35 |
| 2,392,377 | A | * | 1/1946 | Golding | 606/204.35 |
| 2,540,247 | A | * | 2/1951 | Dillon | 606/204.35 |
| 3,804,083 | A | * | 4/1974 | Tupper | 606/204.35 |
| 3,949,741 | A | * | 4/1976 | Hofmann | 606/204.35 |
| 4,674,133 | A | * | 6/1987 | Oschner | 2/206 |
| 4,734,320 | A | * | 3/1988 | Ohira et al. | 428/40.1 |
| 5,336,219 | A | * | 8/1994 | Krantz | 606/215 |
| D355,489 | S | * | 2/1995 | Almond | D24/189 |
| 5,466,456 | A | * | 11/1995 | Glover | 424/401 |
| 5,555,900 | A | * | 9/1996 | Rich | 132/200 |
| 5,582,585 | A | * | 12/1996 | Nash-Morgan | 604/44 |
| 5,755,232 | A | * | 5/1998 | Kalt | 128/845 |
| 5,861,348 | A | * | 1/1999 | Kase | 442/184 |
| 5,976,173 | A | * | 11/1999 | Berke | 606/204.45 |
| 6,029,658 | A | * | 2/2000 | De Voss | 128/200.24 |
| 6,098,616 | A | * | 8/2000 | Lundy et al. | 128/200.24 |
| 6,193,741 | B1 | * | 2/2001 | Heavenridge et al. | 606/204.35 |
| 6,221,382 | B1 | * | 4/2001 | Ishida et al. | 424/443 |
| D471,984 | S | * | 3/2003 | Dunshee et al. | D24/189 |
| 6,572,634 | B2 | * | 6/2003 | Koo | 606/199 |
| 6,649,181 | B1 | * | 11/2003 | Miner | 424/402 |
| 7,066,182 | B1 | * | 6/2006 | Dunshee | 128/888 |
| 7,186,878 | B2 | * | 3/2007 | Beaudry | 602/42 |
| 2002/0051796 | A1 | * | 5/2002 | Gueret | 424/401 |
| 2003/0208230 | A1 | * | 11/2003 | Kim | 606/204.35 |
| 2004/0002676 | A1 | * | 1/2004 | Siegwart et al. | 602/58 |
| 2004/0082897 | A1 | * | 4/2004 | Rangel et al. | 602/59 |
| 2004/0138699 | A1 | * | 7/2004 | Lish | 606/204.35 |
| 2006/0229545 | A1 | * | 10/2006 | Zaguroli | 602/58 |
| 2007/0104909 | A1 | * | 5/2007 | Danielian et al. | 428/40.1 |
| 2007/0104910 | A1 | * | 5/2007 | Danielian et al. | 428/40.1 |
| 2009/0187212 | A1 | * | 7/2009 | Matsui, Hideki | 606/201 |

FOREIGN PATENT DOCUMENTS

| | | | | |
|---|---|---|---|---|
| FR | 2543826 | A | * | 10/1984 |
| JP | 41-17146 | U | | 8/1966 |
| JP | 60365/1976 | U | | 5/1976 |
| JP | 3024084 | U | | 5/1996 |
| JP | 09143026 | A | * | 6/1997 |
| JP | 3049506 | U | | 6/1998 |
| JP | 10-194925 | A | | 7/1998 |
| JP | 10234469 | A | * | 9/1998 |
| JP | 2001011399 | A | * | 1/2001 |
| JP | 2001104366 | A | * | 4/2001 |
| JP | 2002-45232 | A | * | 2/2002 |
| WO | WO 9614822 | A1 | * | 5/1996 |

* cited by examiner (a)

(b)

(a)

Status when the inner corner of an eye is covered by a Mongolian fold.

(b)

Status when edges of a double-edged eyelid stay in parallel up to the inner corner of the eye.

METHOD OF BEAUTIFICATION AND FACELIFTING USING A STRETCH TAPE

BACKGROUND OF THE INVENTION

1. Field of the Invention

The present invention relates to a stretch tape which is used for the purpose of facial facelifting by sticking it to a human face, and especially relates to a stretch tape which is suitable for facelifting of eyelids or a nose, to a stretch tape which pulls, stretches, and fixes wrinkles of a skin surface for the purpose of beautification or facelifting of skins around eyes, skins upside of eyelids and cheek skins and the like, and to a method of beautification and facelifting using the stretch tape thereby.

2. Description of Related Art

Since skins of inner and outer corners of eyes of a Japanese tend to sag over eyes, incising operations for inner or outer corners of eyes have been performed conventionally in order to make the eyes look brighter and slitter. However, since efforts, risks and expense are required for the purpose, incising operations for inner or outer corners of eyes have not so frequently performed.

Although cosmetic surgery can also be performed in order to make a nose high, it also has drawbacks of efforts, risks and expense. Tapes for extending nares are disclosed by JP,2002-518306,A, JP,2002-239017,A, and JP,2002-125992,A, and a corrective appliance for a bridge of a nose is disclosed by JP,2002-345870,A. Also, a tape for forming double-fold eyelids is disclosed in JP,10-304935,A, a pasting corrective appliance for correcting face wrinkles is disclosed in JP,9-143026,A, and a corrective appliance for wrinkles and flabbiness is disclosed by JP,2002-345870,A.

However, these tapes cannot open up inner corners of eyes, and their effect of forming a straight and sharp nose is not enough.

Therefore, the purpose of the present invention is to open up inner corners of eyes or forming a nose straight and sharp by sticking a tape to a predetermined position of a face repeatedly (mainly during sleep) for a prescribed period (between three months and one year), without performing a surgery operation and the like.

Muscles and skins of a human face will become flabby and sag downward with age. Since this causes the face to look older, a facelift operation which pulls up skins and muscles of the face as cosmetic surgery is popular as an operation of rejuvenation.

Adhesive tapes for removing wrinkles and flabbiness of skins are publicly known by JP,2002-45232,A, JP,Y,3090209, JP,10-234469,A, and others. However, the adhesive tape disclosed in JP,2002-45232,A has the same shape as the shape of a Band-Aid, and is described to be stuck only at a side of a neck. JP,3090209,U and JP,10-234469,A also describe sticking positions of the adhesive tape only as on a face, without specifying specific positions, and the tape has no distinctive shape. Although wrinkle stretching tapes are disclosed in JP,10-194962,A, JP,10-23924,A, and JP,2001-335430,A, each of these tapes must be stuck on wrinkles, so that, they have a fault that wrinkles tend to return to an original status after sticking in due course of time.

A tape for pulling hairs at sides of a face is disclosed in JP,2002-229014,A, and a strap for pulling a side of a face are disclosed in JP,9-168424,A, JP,3043517,U, and others. However, all of them have also a fault that wearing them is troublesome or intrusive.

Generally, following items can be mentioned as causes and preventive methods for growing of wrinkles.

1. Three Causes of Growing Wrinkles (1) "Ultraviolet-rays" . . . wrinkles are grown according to optical aging caused by ultraviolet-rays, here, optical aging means skin-aging caused by exposure to ultraviolet rays for years. Both fine wrinkles and deep wrinkles can be grown by ultraviolet rays.

(2) "Dryness" . . . wrinkles are grown by dryness around eyes and at the corners of a mouth. Fine wrinkles are grown by dryness. When leaving fine wrinkles untreated, however, fine wrinkles grown by dryness gradually become deeper.

(3) "Flabbiness" . . . wrinkles are grown on a whole forehead and on skins around eyebrows. Smile-wrinkles at the outer corners of eyes are also this type of wrinkles.

2. Methods of Preventing Wrinkles Around Eyes

Since skins around eyes are thinner than those of other portions of a face with almost no sebum secretion, these portions easily become dry and wrinkles are grown there easily.

(1) "Moisturizing" . . . It is effective to use a moisturizer which does not include irritating materials and which can fully supply moisture and nutrition to the skins.

(2) "Massaging" . . . It is effective to massage the skins gently using an eye cream and the like, or to press skins around eyelids lightly with fingers.

Even when preventive methods as mentioned above are performed, it is impossible to prevent flabbiness caused by aging.

3. Conventional Methods of Removing Wrinkles

Although it may be possible to diminish appearance of fine wrinkles by increasing tautness of skins by using cosmetics or by massaging, deep wrinkles cannot be removed by cosmetics. Real cosmetic surgery may be required for removing wrinkles.

(1) "Facelift operation" . . . An operation of pulling up the skin of a forehead after incision is effective for sags grown by aging on a face skin above eyes, blepharophimosis, sags of eyebrows, smile-wrinkles, transverse wrinkles, glabellar wrinkles, and the like.

(2) "Collagen infusion" . . . Collagen is infused under the skin where wrinkles are grown so that appearance of wrinkles is diminished by increasing tautness of the skin.

(3) "Peeling" . . . New and soft horny cells are grown after exfoliating so that a beautiful skin is born again. However, deep wrinkles cannot be removed by these methods.

Methods mentioned above require expense and time, while having defects such as fears and annoyance of surgery.

Therefore, an object of the present invention is to provide a stretch tape which is stuck around wrinkles to stretch the wrinkles from around so that the wrinkles are fixed in stretched status, and to provide a beautification method using the stretch tape thereof.

DESCRIPTION OF THE INVENTION

The stretch tape of the present invention for eyelid facelifting is characterized in that it is stuck in between eyes and near both inner corners of eyes, or beside and near the outer corner of each eye, enabling facelifting which makes the eyes look slitter and brighter by stretching skins of eyelids by the stretch tape.

The stretch tape of the present invention for eyelid facelifting is further characterized in that the stretch tape is tapered so that the stretch tape points the inner edge or the outer edge of the eye, the width of the stretch tape is between 5 and 15 mm, the length of the stretch tape is between 15 and 30 mm, and the taper angle is between 20 and 60 degrees.

The stretch tape of the present invention for nose facelifting is characterized in that the stretch tape has a shape of an inverted character U or an inverted character V, the top portion of the inverted character U or the inverted character V is stuck to an upper portion of a nose in between eyes, and both foot portions of the inverted character U or the inverted character V are stuck at both sides of a hillside portion of the nose, so that the stretch tape stretches the hillside portion of the nose toward a head.

The stretch tape of the present invention for nose facelifting is further characterized in that the width of the stretch tape is between 5 and 20 mm, each foot length of the inverted U character or the inverted V character is 15 and 35 mm, and a stride angle between feet of the inverted U character or the inverted V character is between 0 and 120 degrees.

The stretch tape of the present invention for facelifting of wings of a nose is characterized in that the shape of the stretch tape is nearly triangle and the center of the triangle is stuck to upper portions of the wings of the nose, so that the stretch tape stimulates cartilages of the wings of the nose to make the wings of the nose smaller.

The stretch tape of the present invention for facelifting of the wings of the nose is further characterized in that the width of the stretch tape is between 5 and 40 mm, the base length of the triangle is 35 and 50 mm, and the vertex angle of the triangle is between 0 and 120 degrees.

Also, the stretch tape of the present invention for beautification and facelifting is characterized in that it is a stretch tape which is stuck on a surface of a skin so that wrinkles on the surface of the skin is pulled, stretched, and fixed, wherein the stretch tape is made of a stretchable base material on which an adhesive material is applied thickly to the thickness of 35 grams per square meters or more.

The stretch tape of the present invention for beautification and facelifting is further characterized in that the stretch tape is made of a base material consisting of urethane nonwoven fabric on which an acrylic adhesive material is applied thickly to the thickness of 35 grams per square meters or more.

The stretch tape of the present invention for beautification and facelifting is further characterized in that the width and the length of the stretch tape are between 15 and 50 mm and the tape end that pulls the skin is shaped roundish.

The method of the present invention for beautification and facelifting is to use one of the aforementioned stretch tapes and to apply a moisturizing and astringing pack to the whole face at bedtime, wherein the stretch tapes are stuck on portions such as skins around eyes, upside of eyelids or on cheeks, for pulling, stretching and fixing wrinkles of the skins from around, and washing away the moisturizing and astringing pack on the next day so that the wrinkles of the skins can be removed.

DETAILED DESCRIPTION OF THE PREFERRED EMBODIMENTS

Preferred embodiments of the present invention will be described in detail referring to accompanying drawings.

First Embodiment

Figure 1:
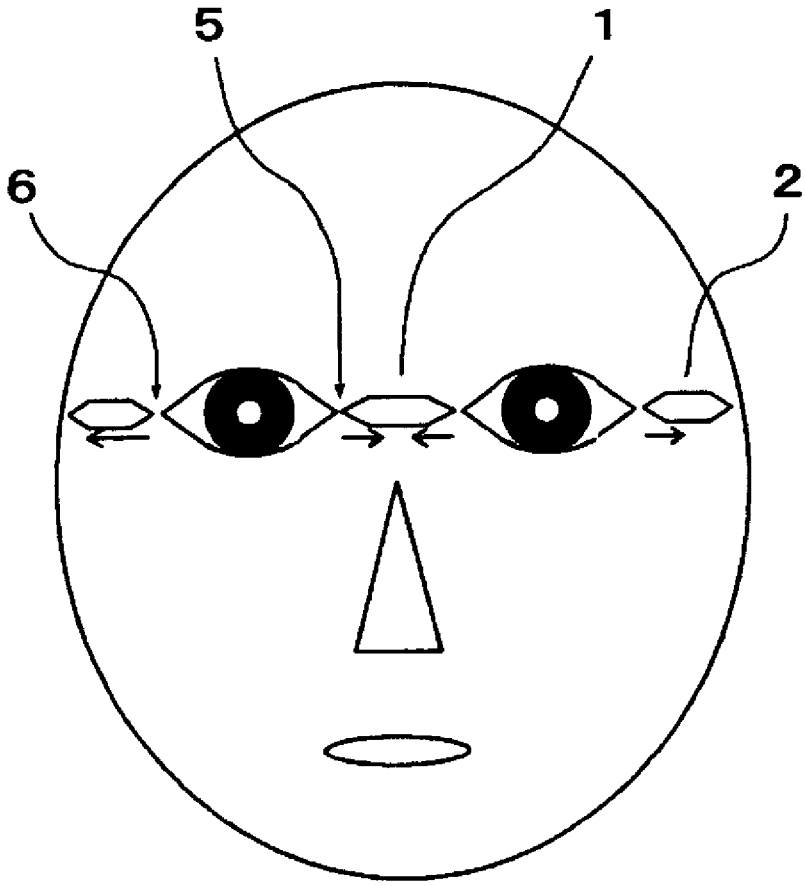
FIG. 1 is a figure showing status when stretch tapes for eyes of the present invention are used.
Figure 2:
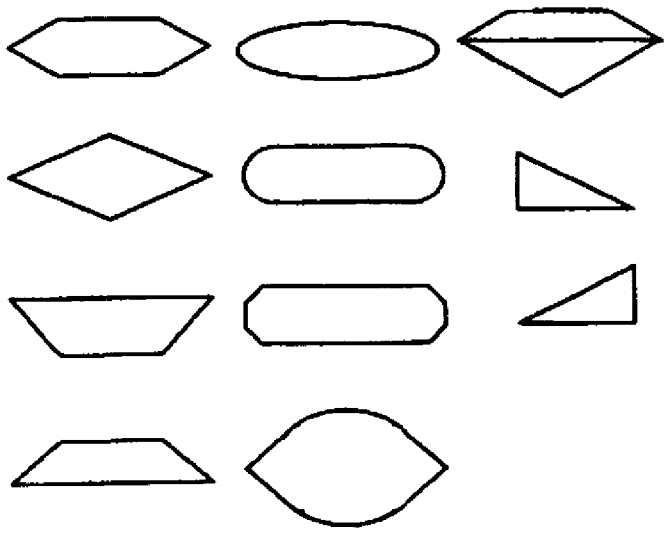
FIG. 2 is a figure showing various figures of the stretch tapes of FIG. 1.

FIG. 1 is a figure showing status when stretch tapes 1 and 2 of the present invention are used for enabling facelifting that makes eyes look slitter and brighter, wherein the stretch tapes are stuck at the inner corner 5 of an eye and at the outer corner 6 of the eye for a long period (three months or more) continuously mainly during sleep at night, so that the skin of an eyelid is pulled and stretched in the directions of arrows in the figure. Some examples of shapes of the stretch tapes 1 and 2 are shown in FIG. 2. It is preferable to make the stretch tape to have an angled shape (including a circular shape or an elliptical shape) to point the inner edge or the outer edge of the eye as shown in FIG. 2, since a stretching force can be concentrated to the inner or outer corners of eyes when such a shape is used.

The tapes are stuck nearly horizontally when intending to open up the inner corner of the eye. In order to open up between inner corners of eyes, either one stretch tape or two stretch tapes can be used between the eyes. In order to stretch the outer corner of the eye, it is preferable to stick the stretch tape in the horizontal direction, since the tape can stretch the outer corner of the eye in the horizontal direction.

Figure 11:
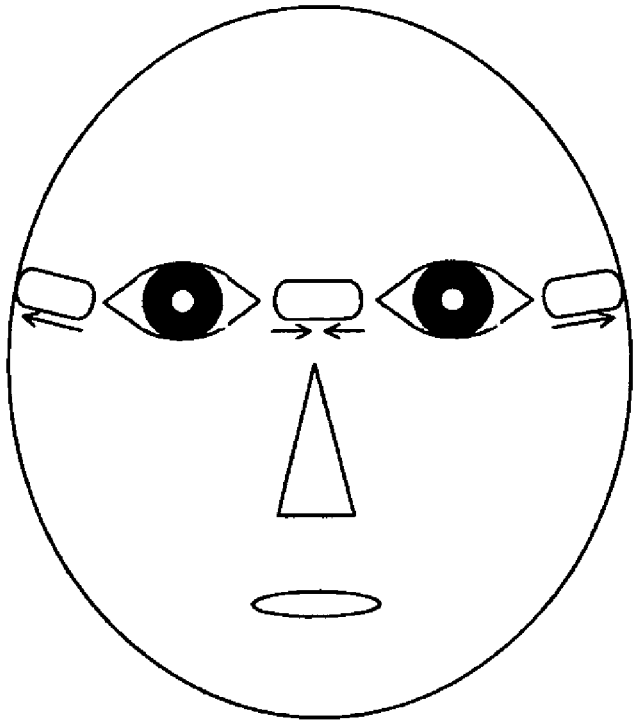
FIG. 11 is a figure showing status when the stretch tapes for eyes of FIG. 1 are used for facelifting of droopy eyes.
Figure 12:
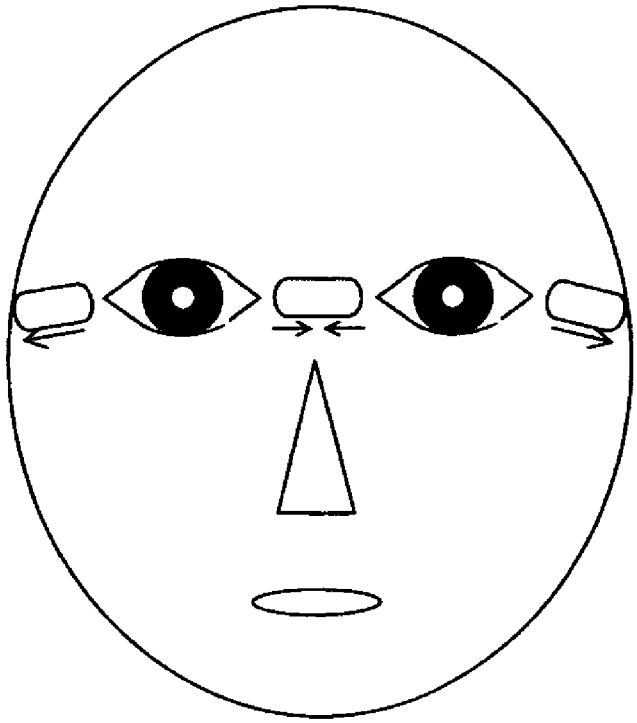
FIG. 12 is a figure showing status when the stretch tapes for eyes of FIG. 1 are used for facelifting of slant eyes.
Figure 13:
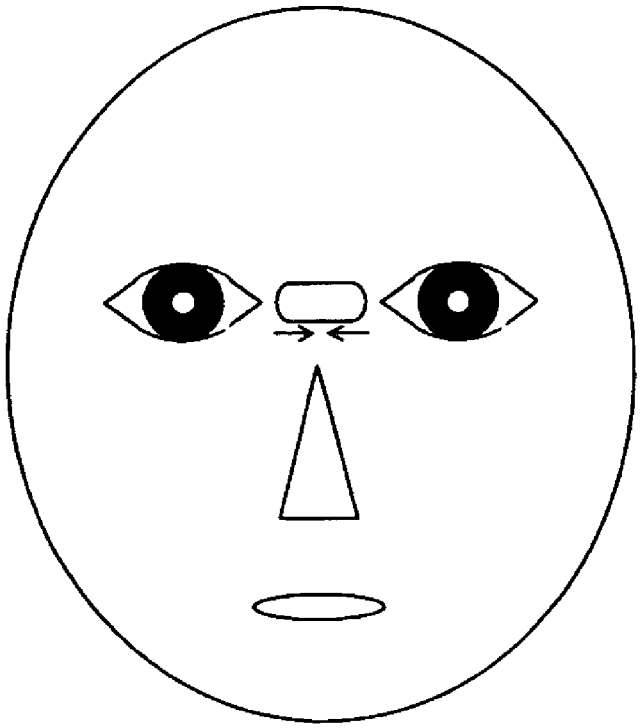
FIG. 13 is a figure showing status when the stretch tape for eyes of FIG. 1 is used for facelifting of distant eyes to become close.
Figure 14:
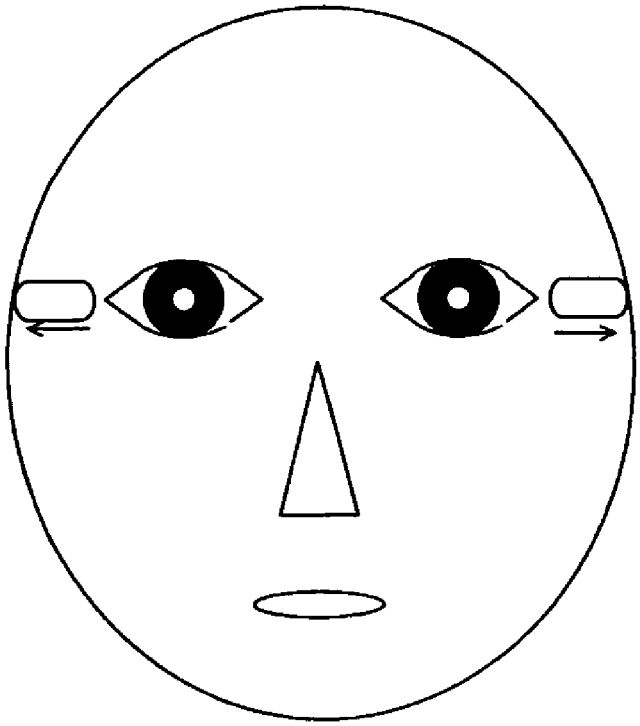
FIG. 14 is a figure showing status when the stretch tapes for eyes of the present invention are used for facelifting of close eyes to become apart.

The stretch tape of the present invention can be used also for facelifting of droopy eyes or slant eyes, by sticking the stretch tape toward obliquely upward (FIG. 11) or toward obliquely downward (FIG. 12) according to the purpose. The stretch tapes of the present invention are effective also for facelifting of close eyes or distant eyes, by stretching the outer corners of eyes toward outer directions (FIG. 14) or toward center direction (FIG. 13) according to the purpose.

Figure 15:
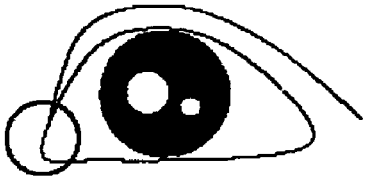
FIG. 15 is a figure showing another effect when the stretch tapes for eyes of FIG. 1 is used for a facelifting of eyes.
Figure 15:
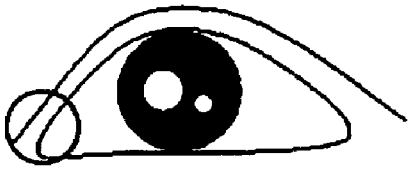

Although a double-edged eyelid of a Japanese becomes single-edged at the inner corner of the eye (FIG. 15A) since the inner corner of an eye of most Japanese is covered by the so-called "Mongolian fold", when the stretch tape of the invention is used, the edges of the double-edged eyelid stay in parallel up to the inner corner of the eye (FIG. 15B) since the stretch tape lifts up the "Mongolian fold".

It is preferable to make the angle of the angled shape of the stretch tapes shown in FIG. 2 between 20 and 60 degrees, to make the width of the stretch tapes around between 5 and 15 mm, and to make the length of the stretch tapes around between 15 and 30 mm. Using the stretch tapes for a long period (three months or more) continuously mainly during sleep at night is effective for opening up the inner corners of eyes naturally, which makes the eyes look slitter and brighter. This has the same effect as incising operation of the inner corners of eyes, without pains of operation, and moreover, enabling facelifting of eyelids at a very low cost.

Second Embodiment

Figure 3:
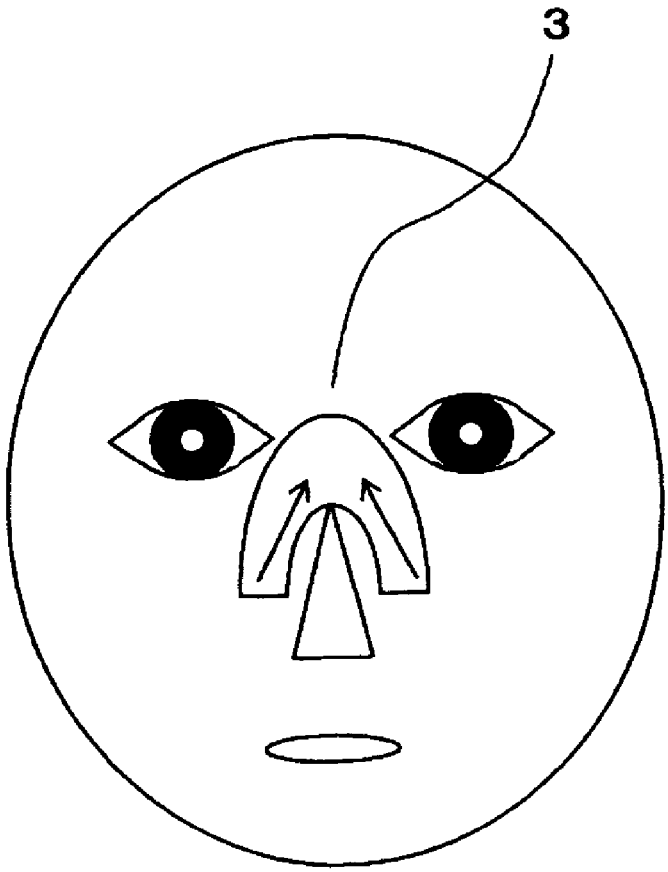
FIG. 3 is a figure showing status when a stretch tape for a nose of the present invention is used.
Figure 4:
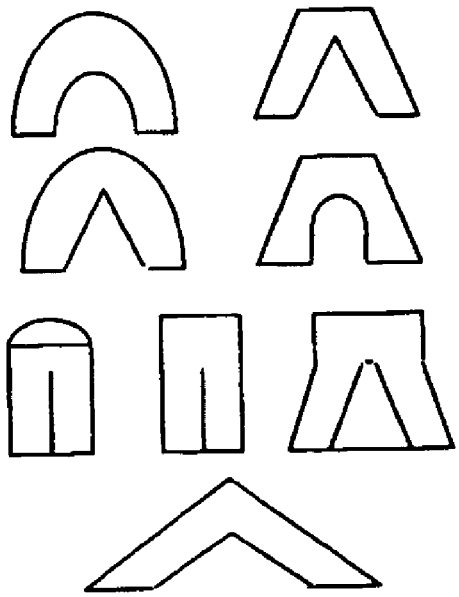
FIG. 4 is a figure showing various shapes of the stretch tapes of FIG. 3.

FIG. 3 is a figure showing the status of the stretch tape of the present invention when stuck to a nose for a long period (more than one year) continuously mainly during sleep at night in order to stimulate the cartilage of the nose for facelifting the nose to make straight and high. Some examples of the shape of the stretch tape are shown in FIG. 4. As shown in FIG. 4, the stretch tape has a shape of an inverted character U or an inverted character V, the top portion of the inverted character U or the inverted character V is stuck to an upper portion of a nose in between eyes, and both foot portions of the inverted character U or the inverted character V are stuck at both sides of the hillside portion of the nose, so that the stretch tape stretches the hillside portion of the nose toward a head (in the directions of the arrows). Since a nasal cavity also spreads at the same time, the stretch tape can be used also for the purpose of snoring prevention, or for the purpose of breathing assist at sports. It is preferable to make the width of the stretch tape between 5 and 20 mm, to make the length of the sides between 15 to 35 mm, and to make the stride angle of the inverted character U or the inverted character V between 0 and 120 degrees. In this case, however, the stride angle seen from the front face becomes between 30 degrees and 45 degrees, since the feet of the inverted character U or the inverted character V are stretched along the sides of the nose.

Whereas a conventional nose tape which is stuck on a nose as shown in JP,2002-518306,A is used to raise the nose upward (i.e. in the direction perpendicular to the face surface), the stretch tape of the present invention for nose facelifting is used to raise the nose in the direction toward the head, which means its pulling direction differs between 60 to 90 degrees from the pulling direction of the conventional nose tape.

A better effect of extending nostrils can be obtained by the stretch tape of the present invention as compared to the conventional nose tape, and also a better effect of making the nose straight and high can be obtained by the stretch tape of the present invention as compared to the conventional nose tape, since the nose is pulled in the vertical direction.

Third Embodiment

Figure 5:
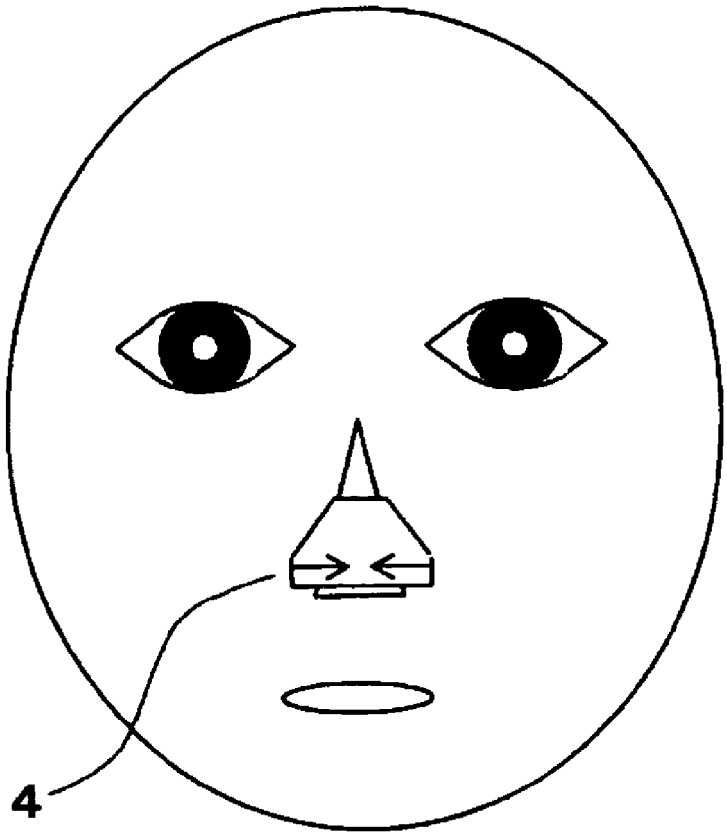
FIG. 5 is a figure showing status when another stretch tape for a nose of the present invention is used.
Figure 6:
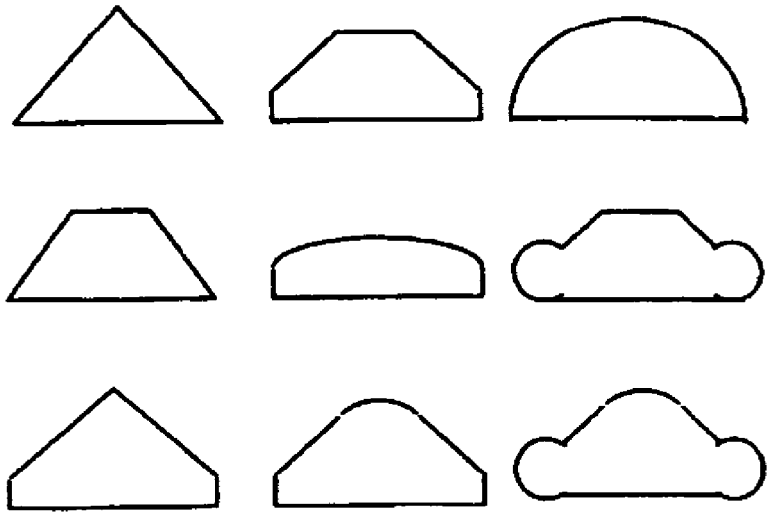
FIG. 6 is a figure showing various shapes of the stretch tape of FIG. 5.

FIG. 5 is a figure showing the status of the stretch tape of the present invention when stuck to the wings of a nose for a long period (more than one year) continuously mainly during sleep at night in order to pull the wings of the nose in the direction of the arrows, stimulating the cartilage of the nose to make the wings of the nose smaller and to facelift the nose to make straight and high. Some examples of the shape of the stretch tape are shown in FIG. 6. The shape of the stretch tape is nearly triangle, as shown in FIG. 6, and the vertex angle of the triangle is preferably between 30 and 120 degrees. Sizes of the stretch tape are preferably between 5 and 40 mm for width, and between 30 and 50 mm for length of the base.

Fourth Embodiment

Figure 7:
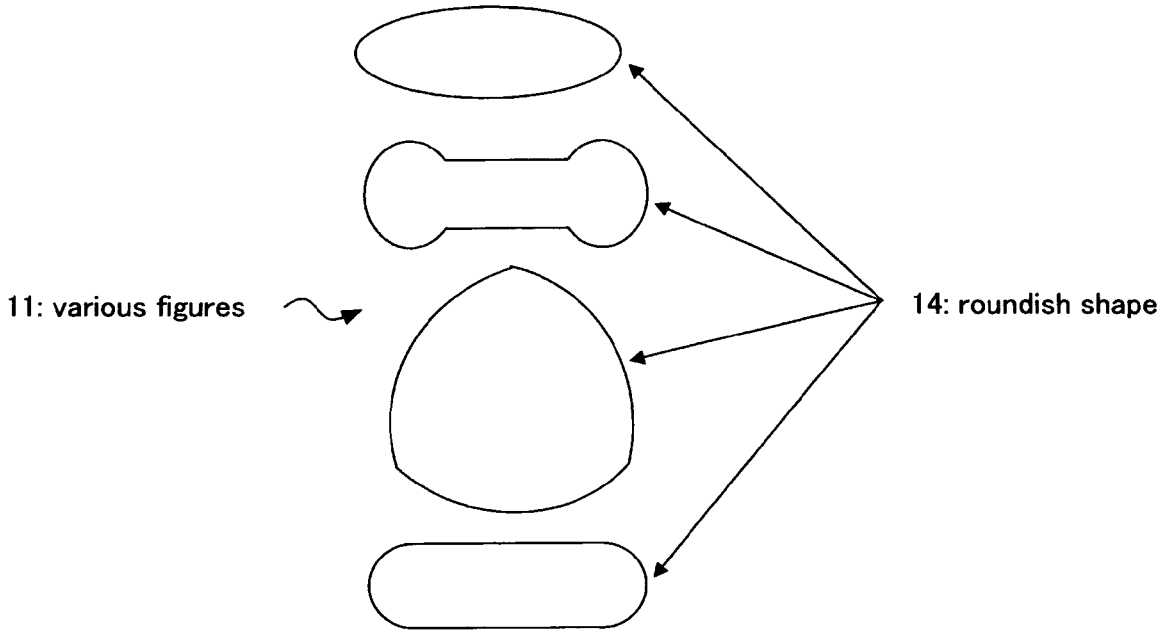
FIG. 7A and FIG. 7B are figures showing shapes of the stretch tapes of the present invention.
Figure 7:
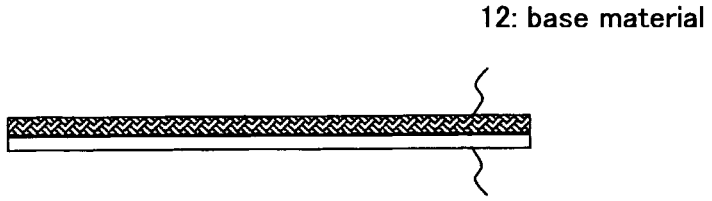

FIG. 7A and FIG. 7B are figures showing plan views and a side view, respectively, of the stretch tapes of the present invention for stretching winkles.

In FIG. 7B, the numeral 12 shows a tape as a base material which is made of urethane nonwoven fabric having water-volatility, breathability, and flexibility which are similar to those of a human skin. The base material of the stretch tape is not limited to urethane nonwoven fabric, but can be made of other base materials having stretchability, such as silicone or urethane. In contrast to the thickness of a conventional adhesive tape (application quantity of 30 grams per square meters), in case of the stretch tape of this invention, the adhesive layer 13 in FIG. 7B is applied thickly as 35 grams per square meter or more. Width and length of the stretch tape are both between 15 and 50 mm, and the tape end faces 14 are shaped roundish as shown in FIG. 7A. As long as being shaped roundish, any of various shapes 11 in FIG. 7A or any other shapes can be used for the stretch tape end faces.

Figure 8:
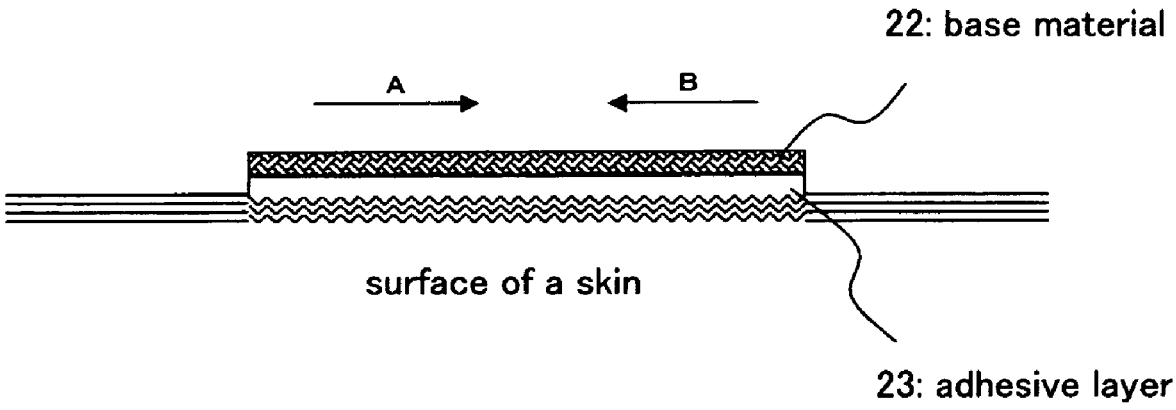
FIG. 8 is a magnified figure showing status when the stretch tapes of FIG. 7A are used.
Figure 9:
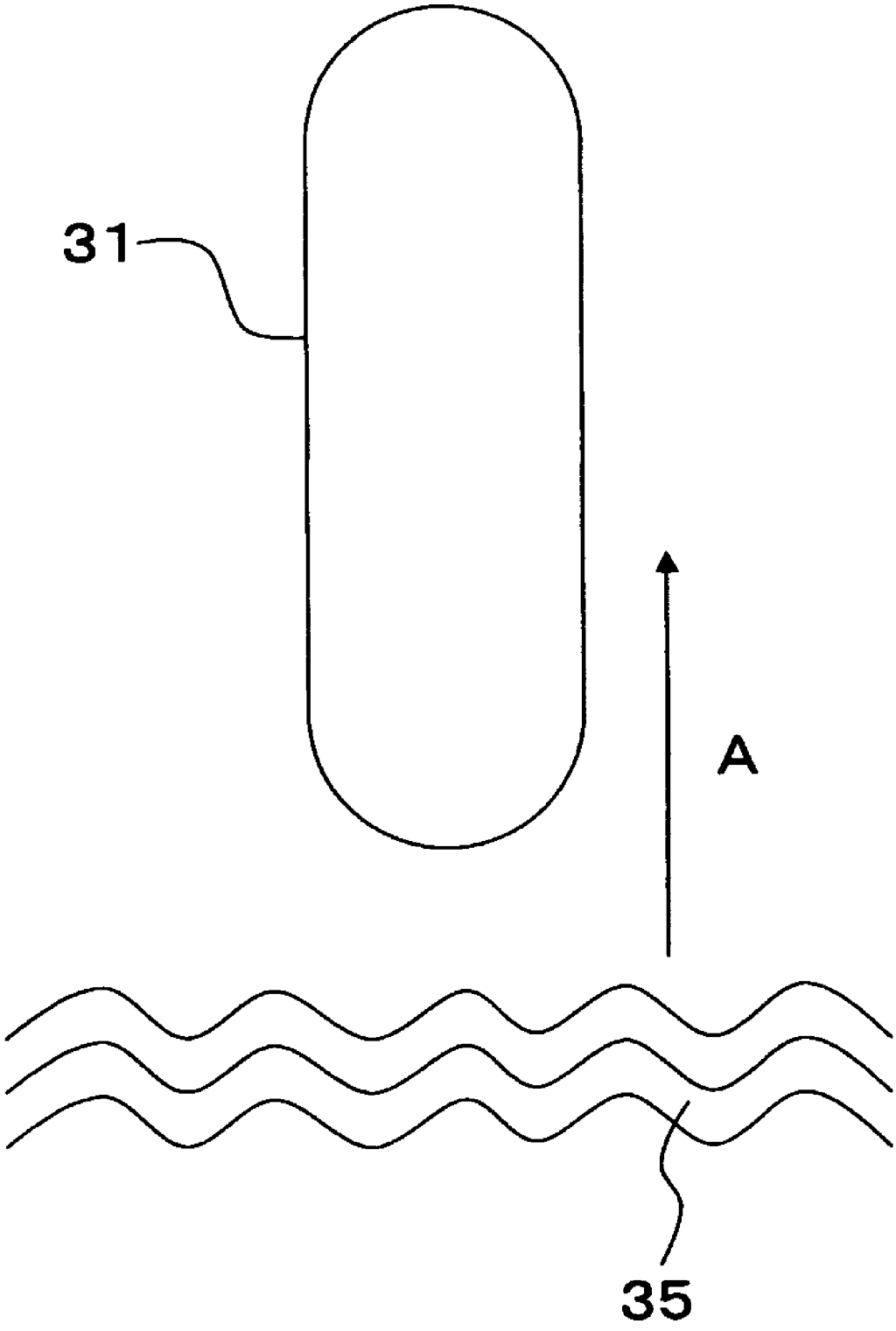
FIG. 9 is a figure showing status when the stretch tapes of FIG. 7A are used.
Figure 10:
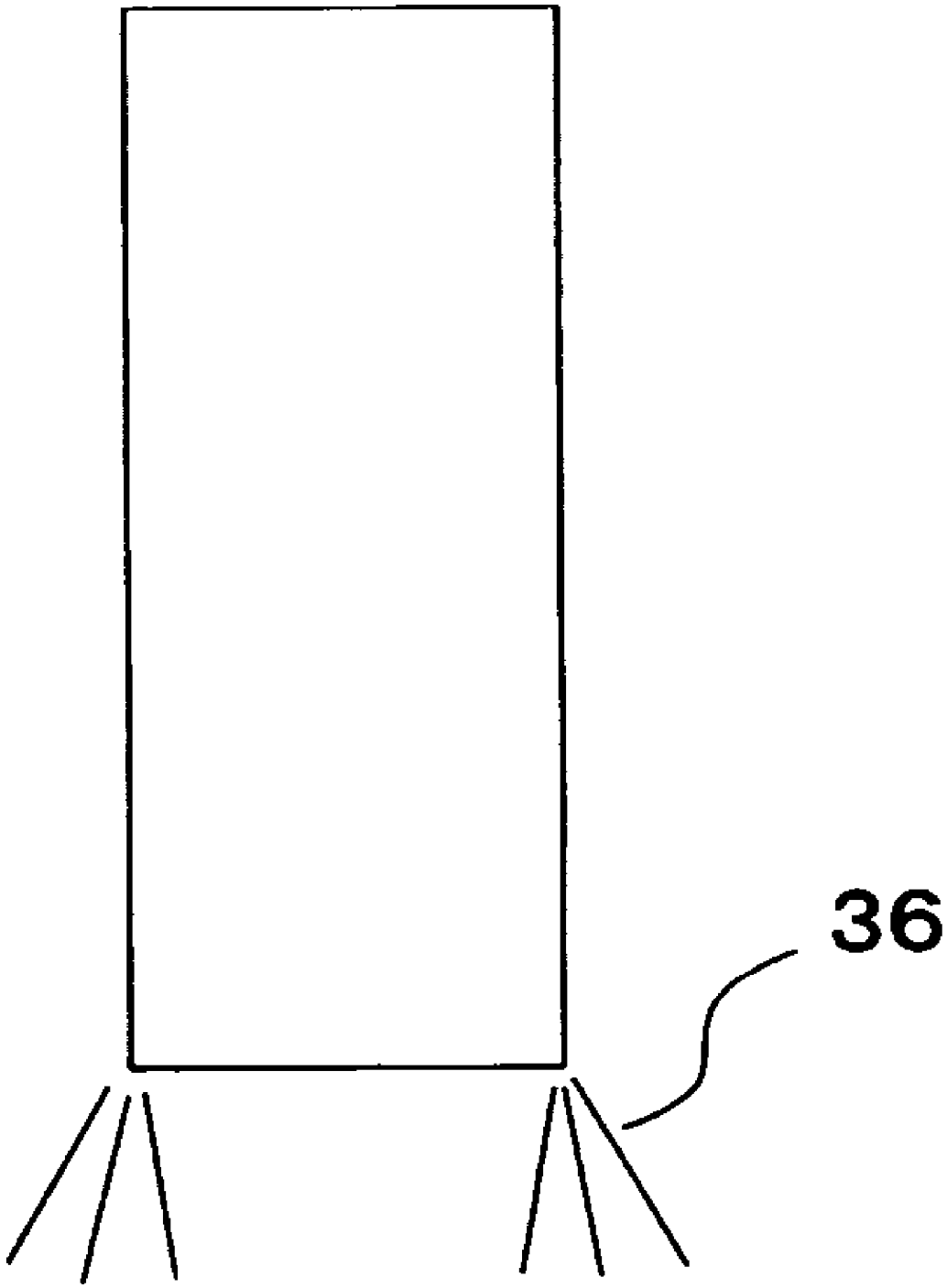
FIG. 10 is a figure showing status when a rectangular stretch tape is used.

FIG. 8 shows an enlarged view when the stretch tape is stuck on a surface of a skin. As shown in FIG. 9, at bedtime, the stretch tape 31 is stuck on the skin around wrinkles in the direction perpendicular to the wrinkles 35 after stretching the wrinkles 35 by fingers and the like. Thus, the wrinkles 35 are fixed in the status as they are stretched toward the direction shown by the arrow A. As described above, since the end face of the stretch tape 31 is shaped roundish as shown by the numeral 14 (FIG. 7A), generation of new wrinkles at the end face of the stretch tape can be prevented. When the end face of the stretch tape has angular corners, a stress is generated on the skin surface at the end face of the stretch tape so that new wrinkles 36 are generated by the stretch tape as shown in FIG. 10 according to the pulling direction (shown by the arrow A in FIG. 9), so that, it is important to make the end face shaped roundish when the stretch tape is used for removing wrinkles. As shown in FIG. 8, when the stretch tape is stuck on the skin surface so that wrinkles are to be stretched, since the tape is stuck expanded, pulling forces in the direction toward inside (directions of arrows A and B in FIG. 8) are applied within the stretch tape. Since the pulling forces compress the skin surface of the part where the above-mentioned stretch tape is stuck, new wrinkles will grow at the skin surface. In order to avoid this to occur, the adhesive layer 23 of the stretch tape of the present invention is applied more thickly than a conventional adhesive tape. Since the adhesive layer is elastic, compressive forces in the stretch tape are absorbed by the thick adhesive layer, so that no stress is applied to the skin surface. That is, even when the stretch tape 22 is compressed, the compressive forces are absorbed by deformation of the adhesive layer 23, without compressing the skin surface. The structure as described above is important especially for preventing generating new wrinkles caused by the stretch tape, when the stretch tape is used for removing wrinkles.

An embodiment of the method of beautification and facelifting using the stretch tape of the present invention is explained in the following.

"The tape-lifting facelifting method" of the present invention stretches wrinkles physically, by pulling skins, fascias, and mimic muscles by using the stretch tape that has similar elasticity and breathability as a human skin before going to bed, without using a scalpel nor a syringe. By repeatedly maintaining lifting status during sleep, mimic muscles shift slowly so that flabbiness and wrinkles of skins around eyes are improved. Additionally, cells of the skins, the fascias, and the mimic muscles are taken over by metabolism, so that the state of the flabbiness and the wrinkles is fixed as they are stretched. It is further effective when an essence, a facial pack or the like containing moisturizing ingredient is used on the lifted skin portion. "The tape-lifting facelifting method" is a revolutionary beautification and facelifting method which can remove flabbiness and wrinkles of skins around eyes by simple home care.

1. Mechanism and Effect of Removing Flabbiness and Wrinkles.

(1) "Mimic muscle deformation" . . . Mimic muscles consist of more than 20 kinds of muscles which open and close eyes, nostrils and the mouth and moves ears, being used for making a complicated face expression which is peculiar to a human being, working cooperatively or antagonistically each other. Any skins other than face skins are not moved by a motion of the muscles, since they are not connected to the muscles. However, since face skins and mimic muscles are united together, face skins move according to the motion of mimic muscles.

It is because face skin moves together with mimic muscles that when laughing outer corners of eyes fall or wrinkles are grown at the outer corners of eyes, and that when getting angry the outer corners of eyes are raised and wrinkles are grown at a glabella, and it is because mimic muscles are frequently deformed that, for a person who laughs often, the outer corners of eyes and eyebrows fall and the shape of skins around eyes are deformed.

Mimic muscles become slack by aging, causing skins around eyes to be slack. Especially, since orbicularis oculi muscles at the outer corners of eyes where connection to venter frontalis muscles is weak tend to become slack, the eye shape is deformed to make droopy eyes by aging.

Therefore, it is generally understood that a major cause of flabbiness and wrinkles on skins around eyes is deformation of mimic muscles.

(2) "tape lifting" . . . When skins around eyes or other skin portions are lifted by using the stretch tape, mimic muscles are lifted together. As a result, the mimic muscles are accustomed to be made deformed in the direction of lifting.

When skins around eyes or other portions which have sagged down by aging are lifted effectively by using the stretch tape which has similar elasticity and breathability to those of the skins, mimic muscles and fascias under the skins are also lifted. When repeatedly performing lifting for a long time (mainly during sleep), the muscles and the fascias are gradually shifted and then fixed. As a result of pulling up skins and subcutaneous tissues by lifting skins around eyes and by lifting skins at the corners of a month, flabbiness of skins around eyes is improved and wrinkles there also become shallow.

(3) "skin moisturizing" . . . When an essence or a facial pack which contains moisturizing ingredient or an astringent is used on a lifted skin portion, the effect of making the keratinized skin portion soft and the effect of making wrinkles shallow are accelerated.

(4) "Protein fixation by metabolism (shape memorization)" . . . Cells of a human body are taken over by metabolism. By repeatedly performing lifting for deformation during a period required for metabolism, the deformation becomes fixed. Proteins have capability of memorizing a shape.

Proteins have a mechanism by which the same shape can be maintained even if whole cells are taken over. This mechanism works for whole cells of a body, and in case of skins, the same wrinkles remain even after all cells are taken over, since shapes of once-grown wrinkles are memorized. However, when making wrinkles to remain stretched and pulled, proteins transmit the status to the following generation cells to make up skins without wrinkles.

(5) "Skins are grown during night" . . . Metabolism of skins becomes most active during sleep. This is because when a human body is awake, much of energy is consumed by metabolism of other portions of the body (the brain, muscles, internal organs, and others) rather than by metabolism of skins. Since activity of metabolism of the other portions falls down during sleep, much of the energy can be used by metabolism of skins. Thus, it is highly effective for removing flabbiness or wrinkles to lift and fix skins, and further to cultivate skins by using a moisturizing facial pack during night when metabolism of skins is active.

(6) "Applications" . . . By using the mechanism of shifting mimic muscles as described above together with stretching skins by the stretch tape, it becomes also possible to deform skins around eyes or other portions, as well as to improve flabbiness of skins around eyes.

2. Difference From Conventional Methods (1) "Removing wrinkles by cosmetics" . . . Microscopic wrinkles can be removed by giving tautness to skins using cosmetics. However, clearly visible wrinkles such as wrinkles at the outer corners of eyes caused from flabbiness by aging cannot be removed.

(2) "Removing wrinkles by cosmetic surgery" . . . Undergoing one of various cosmetic surgeries for removing wrinkles can be a prompt relief, but since it has a risk of failure, and furthermore since it is expensive, presently not so many ordinary people are willing to undergo such an operation.

The tape-lifting facelifting method of the present invention is described below.

3. The Method of Tape-Lifting Facelifting (1) Before going to bed, dip a moderate amount of moisturizing and astringing pack and apply it thinly on skins of the whole face. At applying, do not scrape strongly nor rub into the skins. After performing skin-care using a face toilet or an essence and when the skins become gumless, pull up by fingers two or three points of the skins at one side of the outer corners of eyes and on the skins above eyebrows, confirm proper sticking positions and directions so that flabbiness and wrinkles can be removed, pull and expand the stretch tapes for about 5 mm in length, and then stick them to proper positions for lifting flabby skins.

Pull both ends of the stretch tape with both hands so that the stretch tape is expanded uniformly up to about 120% of its length, and stick the tape to the skin. Pulling the stretch tape too strongly is a burden for the skin and may damage the skin.

The stretch tapes for tape-lifting facelifting are made of a base material using a specific urethane nonwoven fabric having elasticity and breathability similar to those of the skins, and after moisturizing and astringing pack is applied thinly on the skins around eyes, the stretch tapes are used for pulling up the flabby skins so that the wrinkles around eyes are stretched and fixed.

"Lifting up above eyes" . . . Skins become loose and hang down by aging. This is a major cause of wrinkles on skins around eyes. Stick four to five stretch tapes at the outer corners of eyes, above eyebrows and at the center of the forehead according to the status of wrinkles.

This should be performed before going to bed, while, in the next morning, remove the stretch tapes and wash moisturizing and astringing pack away. Repeat above procedures every day. By practicing this way, wrinkles can be removed gradually. In order to reduce the burden for skins, it is better to shift sticking positions of the stretch tapes each other. By continuous use of the stretch tapes this way, wrinkles are gradually stretched by the shape memorizing effect of proteins.

(2) Apply an essence or a facial pack on the portions of the lifted wrinkles.

(3) Be sure to remove the stretch tapes as soon as possible after getting up.

(4) "Duration of using stretch tapes" . . . It is known that one life-cycle of a normal skin in which epidermal cells are born in the basal, grow to reach the horny layer and finally peel off, is about 28 days. Accordingly, the effect of removing flabbiness and wrinkles gradually becomes evident from one month after beginning the method. However, since a long time is required for all cells not only in the surface skin layer but also in the deep skin layer to take over, the stretch tapes should be used at least for three to six months continuously.

(5) Even after wrinkles and flabbiness are removed, the stretch tapes should be used twice or three times a week so that the status can be maintained.

INDUSTRIAL APPLICABILITY

The stretch tape of the present invention enables simple facelifting of eyes or a nose, by using the low-cost stretch tapes for a long period patiently, without undergoing an operation or the like which requires cost and which is a burden to a human body.

The stretch tape of the present invention enables simple beautification and facelifting of wrinkles around eyes, wrinkles on cheek skins and the like, by using the low-cost stretch tapes for a long period patiently, without undergoing an operation or the like which requires cost and which is a burden to the body.

What is claimed is:

1. A method of beautification and facelifting using stretch tapes, comprising:

applying a moisturizing and astringing pack to the whole face of a person at bedtime;

sticking a stretch tape on the skin surface of a face portion of the person to stretch targeted wrinkles of the skin from outside of the targeted wrinkles, the stretch tape being positioned on the skin surface adjacent the targeted wrinkles and not on the targeted wrinkles; and removing the stretch tape and washing away the moisturizing and astringing pack from the skin surface on the next day, wherein said stretch tape comprises a stretchable base material of nonwoven fabric having a lower surface and a sticky adhesive material applied on the lower surface of said base material, and said adhesive material is applied on the entire lower surface of said base material at 35 grams or more per square meter.

2. The method of beautification and facelifling using stretch tapes according to claim 1, wherein a base material of said stretch tape comprises urethane nonwoven fabric and said adhesive material comprises an acrylic adhesive material.

* * * * *